US008220499B2

(12) United States Patent
Fukunishi et al.

(10) Patent No.: US 8,220,499 B2
(45) Date of Patent: Jul. 17, 2012

(54) FABRIC AND PRODUCTION PROCESS THEREOF

(75) Inventors: Noriki Fukunishi, Osaka (JP); Yoshihiro Matsui, Osaka (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 1002 days.

(21) Appl. No.: 10/565,836

(22) PCT Filed: Jul. 26, 2004

(86) PCT No.: PCT/JP2004/011000

§ 371 (c)(1),
(2), (4) Date: Jan. 25, 2006

(87) PCT Pub. No.: WO2005/010256

PCT Pub. Date: Feb. 3, 2005

(65) Prior Publication Data

US 2006/0183390 A1 Aug. 17, 2006

(30) Foreign Application Priority Data

Jul. 29, 2003 (JP) ..... 2003-203146

(51) Int. Cl.
*D03D 15/00* (2006.01)
*D03D 25/00* (2006.01)

(52) U.S. Cl. ..... 139/420 A; 139/426 R

(58) Field of Classification Search ..... 139/420 R, 139/426 R, 420 A
See application file for complete search history.

(56) References Cited

U.S. PATENT DOCUMENTS 2,619,705 A * 12/1952 Foster ..... 428/219
3,593,757 A * 7/1971 Haynes ..... 139/383 R
3,769,060 A * 10/1973 Ida et al. ..... 428/196
3,807,754 A * 4/1974 Rodenbach et al. ..... 280/743.1
4,109,038 A * 8/1978 Hayashi et al. ..... 428/91
4,445,903 A 5/1984 Minemura et al.
4,680,221 A * 7/1987 Murayama et al. ..... 442/126
4,967,548 A * 11/1990 Fangeat et al. ..... 57/224
4,977,016 A 12/1990 Thornton et al.
5,141,542 A * 8/1992 Fangeat et al. ..... 57/224
(Continued)

FOREIGN PATENT DOCUMENTS

JP 58-186663 10/1983
(Continued)

OTHER PUBLICATIONS

New type sportswear fabric Zebra from Toyobo and Itochu, JTN Monthly, v28, n553, pp. 71, 2000.*

*Primary Examiner* — Bobby Muromoto, Jr.
(74) *Attorney, Agent, or Firm* — Fish & Richardson P.C.

(57) ABSTRACT

A fabric wherein the tear strength in the warp cut direction and that in the weft cut direction according to the pendulum method are each from 10 to 50 N, the thickness is 0.07 mm or less, the weight per square-meter is 50 g/m$^2$ or less, and the air permeability is 1.5 cm$^3$/cm$^2$·s or less; and a process for producing the fabric, wherein neither resin finishing nor double side calendaring is conducted. The adoption of the above-mentioned structure makes it possible to provide a fabric which is excellent in all of thinness, lightness, low air permeability and high tear strength and can be used, in particular, for a down proof cloth of a down jacket, and to provide a process for producing the fabric.

18 Claims, 2 Drawing Sheets

U.S. PATENT DOCUMENTS

| | | | | |
|---|---|---|---|---|
| 5,236,775 | A * | 8/1993 | Swoboda et al. | 428/219 |
| 5,273,813 | A | 12/1993 | Akamatsu et al. | |
| 5,277,230 | A * | 1/1994 | Sollars, Jr. | 139/389 |
| 5,323,815 | A * | 6/1994 | Barbeau et al. | 139/420 A |
| 5,474,836 | A * | 12/1995 | Nishimura et al. | 442/301 |
| 5,499,663 | A * | 3/1996 | Barbeau et al. | 139/420 A |
| 5,555,648 | A * | 9/1996 | Griffin | 34/621 |
| 5,637,114 | A * | 6/1997 | Hohnke | 8/137 |
| 5,693,392 | A * | 12/1997 | Bergen et al. | 428/36.1 |
| 5,865,464 | A * | 2/1999 | Kanuma et al. | 280/743.1 |
| 6,283,507 | B1 * | 9/2001 | Kami et al. | 280/743.1 |
| 6,601,614 | B1 * | 8/2003 | Ishii | 139/389 |
| 6,955,193 | B2 * | 10/2005 | Hainsworth et al. | 139/426 R |
| 7,178,762 | B2 * | 2/2007 | Preston | 244/142 |
| 2005/0097877 | A1 * | 5/2005 | Hainsworth et al. | 57/243 |
| 2005/0204719 | A1 * | 9/2005 | Ono et al. | 57/293 |
| 2006/0014920 | A1 * | 1/2006 | Shirakawa et al. | 528/272 |
| 2006/0128243 | A1 * | 6/2006 | Kong et al. | 442/182 |
| 2006/0252322 | A1 * | 11/2006 | DeBenedictis et al. | 442/59 |

FOREIGN PATENT DOCUMENTS

| | | |
|---|---|---|
| JP | 02234943 | 9/1990 |
| JP | 4-2835 | 1/1992 |
| JP | 4-163339 | 6/1992 |
| JP | 06184856 | 7/1994 |
| JP | 9-302549 | 11/1997 |
| JP | 11-247022 | 9/1999 |
| JP | 2000-8247 | 1/2000 |
| JP | 2001-271250 | 10/2001 |
| JP | 2002020944 | 1/2002 |
| JP | 2002220759 | 8/2002 |
| JP | 2003-55859 | 2/2003 |
| JP | 2004339640 | 12/2004 |

* cited by examiner

FABRIC AND PRODUCTION PROCESS THEREOF

CROSS REFERENCE TO RELATED APPLICATIONS

This application is a national phase filing under 35 U.S.C. §371 of international application number PCT/JP2004/011000, filed Jul. 26, 2004, which claims the benefit of priority of Japanese application number 2003-203146, filed Jul. 29, 2003. The disclosures of the prior applications are considered part of (and are incorporated by reference in) the disclosure of this application.

TECHNICAL FIELD

The present invention relates to a thin and light fabric excellent in tear strength, in particular, a fabric from which cotton or down is restrained from spouting out. The fabric is in particular preferably used for a down jacket or the like.

BACKGROUND ART

Conventionally, silk or cotton has been used as cloth from which cotton or down is restrained from spouting out, which is used for outerwear or Japanese bedding (futon) side cloth, since it is excellent in feeling or comfortableness.

However, cloth made of a natural fiber is low in tear strength and poor in durability; therefore, when the cloth is used particularly for outerwear, there is caused a problem that cotton or down spouts out easily from an elbow or sleeve portion thereof.

A polyester multifilament, a nylon multifilament and a composite synthetic fiber fabric thereof have also been used in many cases since mechanical properties thereof are excellent. These synthetic fiber fabrics are frequently used particularly for coats, blousons, golf and outdoor wears, and so forth since they are soft, light, windproof, highly water-repellent, and highly strong. For example, an attempt has been made for raising the strength of a polyamide filament in order to obtain a fibrous product for which tear strength is required (see, for example, Japanese Patent Application Laid-Open No. 2003-55859), and there is disclosed a method of raising the draw ratio thereof to give polyamide filaments having a high strength. However, about such a yarn, the strength thereof becomes high when it is lengthened by 10%. Thus, conversely, the elongation percentage becomes low so that the feeling of the fabric becomes hard. When the elongation percentage becomes low, the following is caused through the process wherein the fabric is torn: the number of yarns subjected to the tearing becomes small, so that stress concentrates easily onto any one of the yarns. Thus, conversely, the tear strength becomes low. This case is not favorable. When yarn having a large linear density is used to heighten the tear strength of the fabric, the fabric becomes thick. Thus, the feeling thereof becomes hard, and the fabric is unsuitable for articles which are required to be stored in a compact form, such as a tent, a paraglider, and a parachute.

Even about fabrics wherein a synthetic fiber is used, the weft tear strength becomes relatively low on the basis of the weft weave density thereof. Thus, in order to set the weft tear strength to 10 N or more, it is indispensable to set the weave density of the warp or weft thereof per 2.54 cm to a small value. For example, about 33 dtex nylon filaments, it is necessary to set the total number of the yarns for the warp and weft to 280 or less per 2.54-cm (see, for example, Japanese Patent Application Laid-Open No. 11-247022). In order to make air permeability low, fabrics having a plain weave design have hitherto been developed. However, these cannot have a sufficient tear strength if the linear density thereof is not set to 44 dtex or more. Thus, a fabric which satisfies all of lightness, low air permeability and high tear strength at a high level has not been developed.

An object of the present invention is to solve the above-mentioned problems in the prior art; and to provide a fabric which is excellent in all of lightness, low air permeability and high tear strength and which can be used particularly as a down proof cloth of a down jacket, and a production process thereof.

DISCLOSURE OF THE INVENTION

Figure 1:
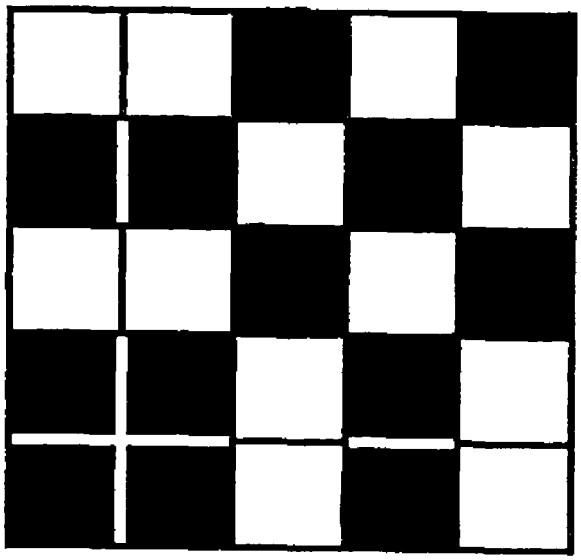
FIG. 1 is a chart illustrating an example of the weave design of the fabric of the present invention.

The inventors have made eager investigations to solve the above-mentioned problems, and made the present invention.

Accordingly, the present invention is made of the following structures:

1. A fabric wherein the tear strength in the warp cut direction and that in the weft cut direction according to the pendulum method are each from 10 to 50 N, the weight per square-meter is 50 g/m$^2$ or less, and the air permeability is 1.5 cm$^3$/cm$^2$·s or less.
2. The fabric according to the above-mentioned item 1, wherein the bending rigidity according to KES is 0.025 gf·cm$^2$/cm or less.
3. The fabric according to the above-mentioned item 1 or 2, wherein the thickness is 0.07 mm or less.
4. The fabric according to any one of the above-mentioned items 1 to 3, wherein the cover factor is from 1600 to 2000.
5. The fabric according to any one of the above-mentioned items 1 to 4, wherein the ratio of the warp density to the weft density is from 0.9 to 1.2.
6. The fabric according to any one of the above-mentioned items 1 to 5, characterized by using a polyamide multifilament wherein the yarn linear density is 30 dtex or less and the filament fineness is 1.2 dtex or less.
7. The fabric according to any one of the above-mentioned items 1 to 6, characterized by using a nylon 6 multifilament wherein the yarn linear density is 30 dtex or less and the filament fineness is 1.2 dtex or less.
8. The fabric according to any one of the above-mentioned items 1 to 7, which has a rip stop weave wherein the lip widths of the longitude and latitude thereof are each 1.5 mm or less.
9. A process for producing the fabric according to any one of the above-mentioned items 1 to 8, wherein neither resin finishing nor double side calendaring is conducted.
10. The process for producing the fabric according to the above-mentioned item 9, wherein single side calendaring is conducted.

Best Mode For Carrying Out The Invention

The present invention will be described in detail hereinafter.

About the fabric of the present invention, the tear strength(s) in the warp cut direction and/or that in the weft cut direction according to the pendulum method is/are preferably from 10 to 50 N. If the tear strength(s) is/are less than 10 N, the tear strength of the fabric easily becomes insufficient in accordance with the usage thereof. In order for the tear strength to exceed 50 N, it is necessary to make the yarn linear density thereof large. The texture thereof unfavorably becomes thick and hard accordingly. Both of the tear strengths in the warp and the weft directions are more preferably from 12 to 40 N, even more preferably from 14 to 30 N.

The air permeability of the fabric of the invention is preferably 1.5 $cm^3/cm^2 \cdot s$ or less, more preferably 1.0 $cm^3/cm^2 \cdot s$ or less, even more preferably 0.80 $cm^3/cm^2 \cdot s$ or less. For use for down wear, a down jacket, a sleeping bag, or the like, a fabric is used as a down proof cloth thereof, and wadding is filled thereinto. Accordingly, if the air permeability of the fabric is more than 1 $cm^3/cm^2 \cdot s$, there is easily caused an inconvenience that relatively small feathers, or bristle type wadding or staples having a small fiber diameter or a small number of crimps are unfavorably spouted from the inside. The fabric is better as the air permeability thereof is smaller. However, the air permeability is usually 0.1 $cm^3/cm^2 \cdot s$ or more.

The weight per square-meter of the fabric of the invention is preferably 50 $g/m^2$ or less, more preferably 45 $g/m^2$ or less, even more preferably 40 $g/m^2$ or less. If the weight per square-meter of the fabric is more than 50 $g/m^2$, the fabric is not easily used for an article the thinness of which is required. However, if the weight per square-meter is too small, the tear strength may be insufficient. Accordingly, the weight per square-meter is preferably 10 $g/m^2$ or more.

The fiber used in the invention is preferably a polyamide multifilament. The polyamide multifilament is made from synthetic polymer having amide bonds, and is filaments excellent in high strength, high toughness, wear resistance, and dimensional stability. The fiber is preferred for sleeping bags, tents, paragliders, parachutes and other materials, or for sportswear, such as ski or snowboard wear and outdoor wear. A main target of the invention is particularly used as a compact, soft and thin fabric, such as a down proof cloth of down wear; thus, for the purpose of satisfying lightness and tear strength at a high level and from the viewpoint of costs, a nylon multifilament, in particular a nylon 6 or nylon 66 multifilament, is preferably used.

The polyamide which constitutes the polyamide multifilament may be a copolymer or a mixture comprising mainly polyamide. In order to improve the hygroscopicity, a hygroscopic monomer may be copolymerized therewith. The polyamide multifilament may be a sheath-core type conjugate polyamide multifilament wherein a hygroscopic resin is confined into its core portion at the stage for producing the multifilament.

The sectional shape of the filaments which constitute the fabric of the invention is not particularly limited, and may be round, polygonal, multileaf-shaped, hollow, cross-shaped or oval, or be any especial deformed sectional shape. The multifilament may be a cluster of filaments with different sectional shapes. The modification degree or the hollow ratio thereof is not particularly limited; however, a round section, which does not easily generate a feeling of wrongness in gloss feeling, is preferred since an excessively strong gloss feeling is not preferred in many cases. An oval section is in particular preferably used since the air permeability can be lowered. What is called thick and thin yarn, which has thick and thin unevenness in the fiber axis direction thereof, may be used.

A hygroscopic material, an antioxidizing agent, a delustering agent, an ultraviolet absorbent, an antibacterial agent and so on may be added, alone or in the form of a mixture thereof, to the filaments which constitute the fabric of the invention. Properties of the fiber other than the stress-strain properties thereof, for example, the boiled water shrinkage ratio thereof, the thermal stress thereof, birefringence, and unevenness of thickness are not particularly limited. The fiber may be subjected to crimpling processing such as false-twist texturing. The fiber may be a combined intermingled filament yarn or a composite yarn made of filaments having different shrinkage ratios or different sectional shapes.

The relative viscosity of the fiber used in the invention is desirably 3.2 or more. If the relative viscosity is less than 3.2, there are easily caused problems such as product-tear and a drop in the burst strength, based on a shortage of the breaking strength, and a deterioration in processing runability and a deterioration in product-durability, based on a shortage of the breaking elongation. Even if the stress-strain balance is adjusted in this case, a fiber having a low relative viscosity comes to have a low breaking tenacity and elongation (toughness) since this fiber has many molecular chain terminals as is meant by a low molecular weight thereof and thus the disorder of the molecule chain and the bonding power in the fiber axis direction are relatively low. Accordingly, fluff or yarn breakage is easily caused under a high tension or a high friction. If the relative viscosity is more than 4.5, a high toughness can be obtained. However, polymerizing facilities or spinning facilities corresponding to high viscosity become necessary. Additionally, the productivity thereof lowers remarkably because of the high viscosity; accordingly, costs for the original yarn increase so as to cause easily a problem that inexpensive and highly functional products cannot be supplied to customers. The relative viscosity is preferably not less than 3.3 nor more than 4.5, more preferably 3.5 or more and 4.0 or less.

The method for producing the above-mentioned polyamide multifilament is not particularly limited. The multifilament can be produced by means of a spinning drawing continuous machine of a spin-draw type, or through two steps using a spinning machine and a drawing machine. In the case of the spin-draw type, the filament is spun at a spun yarn pulling godet roller rotary speed ranging preferably from 1500 to 4000 m/minute, more preferably from 2000 to 3000 m/minute. Subsequently, the yarn is drawn to adjust the breaking strength and the breaking elongation thereof to a value of 4.5 cN/dtex or more and that of 45 to 55%, respectively.

The strength of the fiber used in the invention is desirably from 1.5 to 2.5 cN/dtex when the fiber is lengthened by 10%. If the strength is less than 1.5 cN/dtex at the time of the 10% elongation, the fabric is largely affected by a variation in the tension when the fiber is woven. Consequently, the fabric exhibits uneven dimensional stability, and unevenness in shrinkage following it. Thus, the dimensional stability of a product therefrom becomes unstable, so as to cause unfavorably a problem that a product loss increases. If the strength is more than 2.5 cN/dtex, unfavorably the following problem is easily caused: when the fiber is woven into a high density, the feeling of the woven fabric becomes hard.

The elongation of the polyamide filament is desirably from 45 to 55%. If the elongation is less than 45%, stress is easily concentrated, at the time of tearing the fabric, onto a single yarn which is being torn out of the yarns thereof so that the tear strength unfavorably lowers. It appears that: if the tension elongation of the yarn which constitutes the fabric is high, stress is applied to not only the single yarn which is being torn but also many yarns, such as a yarn which is to be torn next and a yarn which is to be torn after next, by the elongation of the yarns; consequently, stress applied to each of the yarns decreases so that the tear strength increases. Furthermore, the yarns cannot follow frictional resistance or tensile force change to various yarn-contacting members, which is associated with an increase in the producing speed of the fabric and the density thereof, and a decrease in the fineness thereof, so as to cause a problem that the frequency of the generation of yarn breakage increases. If the elongation is more than 55%, the breaking strength lowers even if various spinning drawing conditions are adjusted. Thus, unfavorably, there is easily caused a problem that the tear strength lowers when the filament is made into a fabric. The elongation is more preferably in the range of 47 to 53%.

The bending rigidity of the fabric of the invention is preferably 0.025 gf·cm$^2$/cm or less (1 gf=0.0098 N). The present inventors have found out that the fact that the low bending rigidity of the fabric, in other words, the fabric is soft or flexible, is a very important factor for satisfying lightness, tear strength and air permeability, which are targets of the invention, at the same time. Hitherto, it has been general to adopt an action of making the fineness of a fiber large in order to improve the tear strength of fabric or the like. In the case of fabric, the breaking strength of the yarns thereof becomes low when the fiber fineness thereof is made small. Additionally, the contact area between the warp and the weft increases so that the friction between the warp and the weft also increases. Consequently, restraint points therein do not move so that the yarns are cut one by one, in particular, when the fabric is torn in a single-tongue method. As a result, the tear strength becomes low. In order to prevent this, the contact area between the restraint points of the warp and the weft is made small, that is, friction in the restraint points is made low. For this purpose, the fiber fineness is made large or slip between the warp and the weft is made easy in many cases, whereby similar effects are gained. However, this is a countermeasure suitable for a case where tear stress is slowly applied over a relatively long time, as in the single-tongue method. For example, in sewing portions of the body of a bag and a handle belt thereof, tear stress is slowly applied to the sewing portions and non-sewing portions just adjacent thereto over a relatively long time; therefore, measurement based on the single-tongue method is suitable.

However, in cloth which is preferably used as a down proof cloth for down as in the invention, a case where stress is slowly applied thereto as in the single-tongue method is rare. Rather, instantaneous stress acts thereto in many cases. In the case that the cloth is used, for example, as wear for sports such as ski, the down proof cloth thereof may be caught by some thing so as to be broken when a person who wears it is sliding or falls down. It is appropriate to measure the instantaneous stress applied at this time by the pendulum method. The inventors have ascertained in the middle of their investigation that high numerical values have been hitherto observed according to the single-tongue method but high numerical values are not necessarily observed according to the pendulum method. Out detailed investigation of this fact has demonstrated that: when a yarn has a large fiber fineness, a high numerical value is observed according to the single-tongue method; however, according to the pendulum method, the value tends to be lower than values of yarns having a small fiber fineness. This would be because the fiber does not slip easily in the restraint points against instantaneous stress so that difference is not generated.

In the middle of further investigation, it has been found out that bending flexibility of cloth has a high correlation with the pendulum method, and the matter that the cloth is made flexible is largely affected by not only the matter that the fiber fineness is made small but also the matter that the cloth is subjected to neither resin finishing nor double side calendaring. Reasons for this are unclear, but would be based on the following: when shearing stress is applied to the face of the cloth in the direction perpendicular thereto, the shearing force is applied thereto without being changed, so that the cloth is easily cut; but if the cloth has a large bending flexibility, the fiber to be cut is easily bent in an instant so that shearing force is dispersed into the direction of the fiber axis and directions perpendicular to the fiber axis direction. The bending rigidity is more preferably 0.020 gf·cm$^2$/cm or less, even more preferably 0.015 gf·cm$^2$/cm or less.

The thickness of the fabric of the invention is preferably 0.07 mm or less. If the thickness of the fabric is more than 0.07 mm, feeling of the fabric becomes hard and the fabric is not easily used for an article the thinness of which is required. The thickness is more preferably 0.068 mm or less.

About the fabric of the invention, the cover factor (CF) represented by the following equation is preferably from 1600 to 2000: $CF=T\times(DT)^{1/2}+W\times(DW)^{1/2}$ wherein T represents the warp density (the number of yarns/2.54-cm) of the fabric, W represents the weft density (the number of yarns/2.54-cm), and DT and DW represent the fineness (dtex) of the warp constituting the fabric and that (dtex) of the weft constituting it, respectively. If the cover factor is less than 1600, the fabric becomes thin and light but the air permeability does not become satisfactory at ease. On the other hand, if the cover factor is more than 2000, the air permeability becomes satisfactory but the fabric unfavorably becomes heavy. The cover factor is more preferably from 1700 to 1900.

About the fabric of the invention, the ratio obtained by dividing the warp density by the weft density is preferably from 0.9 to 1.2. The density of the weft is limited; therefore, in order to set this value to less than 0.9, it is indispensable to make the number of yarns for the warp small. In this case, that is, in the case that this value is less than 0.9, the air permeability does not become a satisfactory value at ease. Thus, the case is not preferable. In the case that this value is more than 1.2, distances between restraint points in the weft become too short. Thus, a thin fabric having a satisfactory tear strength is not easily obtained. The ratio is more preferably from 0.95 to 1.1.

The linear density of the yarn used in the fabric of the invention is 30 dtex or less, and the fiber fineness thereof is preferably 1.2 dtex or less. If the yarn linear density is more than 30 dtex, the fabric is unfavorably liable to become heavy. If the fiber fineness is more than 1.2 dtex, the air permeability does not become satisfactory at ease and further the tear strength drops so as not to become satisfactory at ease. The yarn linear density and the fiber fineness are more preferably 25 dtex or less and 1.1 dtex or less, respectively.

A main target of the fabric of the invention is that the fabric is used for a compact, soft and thin fabric, such as a down proof cloth for down wear. In order to satisfy lightness and tear strength at a high level, the weave design of the fabric is plain weave, or rip stop weave wherein plain weave is combined with rib weave. It is particularly preferred to make the fabric so as to have rip stop weave in order to make the tear strength of the fabric large. The number of the rib weave portions in the rip stop weave may be two or more. In general, the number of rib weave is from 2 to 5. The fabric may have double rip stop weave. In the invention, details of the rip stop weave are not limited. However, if the size of patterned squares in the rip stop weave is too large, the effect of improving the tear strength of the whole of the fabric easily becomes poor. It is therefore desired to design the fabric to have checked patterns preferably having a size of 5 mm or less, more preferably having a size of 1.5 mm or less. The rip stop weave having such a small size contributes to a large improvement in the tear strength. Furthermore, in checked patterns having a size of 5 mm or less, the air permeability thereof does not change very much even if the space between the checks is changed. Thus, it is particularly preferred to adopt such rip stop weave. In a square portion of rip structure weave, two or more yarns are arranged to constitute the portion. However, weave wherein one yarn having a larger linear density than that of yarn of a plain weave portion is inserted thereinto so as to constitute patterned squares is defined as one kind of rip stop weave in the invention. In this case, the fiber fineness can be made larger or smaller than that of the yarn of the plain weave portion. The size is even more preferably 0.8 mm or less.

In the process for producing the fabric in the invention, it is preferred to conduct neither resin finishing nor double side calendaring. In the case of producing a low-gas-permeability fabric of a conventional thin cloth type, the fabric is subjected to resin finishing and/or double side calendaring. However, when the resin finishing is conducted, the feeling becomes hard or folded creases are easily generated so that down or feathers spout easily from the portions. Alternatively, when the wear is used for a long time, a problem that the resin is peeled is caused. In the case that the double side calendaring is conducted, the gloss of the surface of the fabric is unfavorably exhibited too much. In the case that single side calendaring is applied to the rear face of the fabric, gloss rarely becomes a problem when the fabric is made into a product. Thus, the single side calendaring is preferably adopted. Double side calendaring easily makes the tear strength low. Thus, the double side calendaring is not preferable. Even when double side calendaring is conducted, a case where calendaring conditions for the two surfaces are made different so that only the same effect as in the case of single side calendaring is produced, for example, a case where the rear face is subjected to high-temperature calendaring and the front face is subjected to low-temperature calendaring can be judged to be substantially single side calendaring. The glossiness of at least one of the two surfaces is preferably 3.0 or less, more preferably 2.6 or less.

EXAMPLES

The present invention will be described on the basis of the following examples. Evaluating methods used in the invention are as follows:

(Relative Viscosity)

A sample is dissolved into a 96.3±0.1% by weight, concentrated sulfuric acid of an extra pure reagent so as to give a polymer concentration of 10 mg/ml, thereby preparing a sample solution. An Ostwald viscometer giving a water dropping time of 6 to 7 seconds at 20±0.05° C. is used to measure the relative solution viscosity. At the time of the measurement, the same viscometer is used, and the relative viscosity RV is calculated from the ratio between the dropping time T0 (second) of 20 ml of the same sulfuric acid as used when the sample solution is prepared and the dropping time T1 (second) of 20 ml of the sample solution, using the following equation:

$$RV=T1/T0$$

(breaking strength DT (cN/dtex), breaking elongation: DE (%): stress at the time of 10% elongation) A 4310 model of Instron Japan Co., Ltd. is used to measure them. An initial load of 1/33 gram is applied per yarn linear density (dtex), and an S-S chart thereof is prepared under conditions of a yarn length of 20 cm and a tensile speed of 20 cm/minute. For each sample, measurement is made under a condition of n=3, and the breaking elongations, the breaking strengths and the stresses at the time of 10% elongation are read out from charts. The average of each of the properties is calculated. Each of the stresses at the time of 10% elongation and the breaking strengths is obtained through division by the linear density (dtex).

(Fineness (dtex))

Three skeins of polyamide multifilaments of 100 m length are prepared. The weight (g) of each of them is measured, and the average is obtained. The average is then multiplied by 100.

(Air Permeability)

It is according to the air permeability prescribed in JIS-L-1096 8. 27. 1 (Frazier type method, A method).

(Thickness)

About a fabric not subjected to film processing such as coating or lamination, the thickness of the fabric is measured at its five points with a thickness meter. The average of the resultant values is calculated.

About a fabric subjected to film processing, a scanning electron microscope is used to take a photograph of its section. The space between outermost filaments positioned in both sides of the fabric is measured at 5 random positions. The average of the resultant values is calculated with conversion based on the magnification of the photo.

(Bending Rigidity)

A bending property tester KES-FB2 manufactured by Kato Tech Co., Ltd. is used, and at least two test pieces, 20 cm×20 cm, are collected along the width direction thereof. The pieces are each grasped with a chuck having an interval of 1 cm, and a pure bending test for constant velocity curvature is made within the range of curvatures K=−2.5 to +2.5. The deformation velocity is 0.50 (1/cm/second), and the samples are each measured in the state that they are made vertical in order to reduce the effect of gravity. The direction in which the warp is bent is defined as longitude, and the direction in which the weft is bent is defined as latitude. The average thereof is defined as the value of bending rigidity. The environment for the measurement is as follows: 20° C., and 65% RH. The unit is $gf \cdot cm^2/cm$.

(Glossiness)

A digital angle-variable photometer UGV-5D manufactured by Suga Test Instruments Co., Ltd. is used, and the light-receiving angle and the incident angle thereof are each adjusted to 45°. A lower value out of the average of two glossinesses in the warp direction and the weft direction on the front face and that of two glossinesses in the same directions on the rear face is defined as glossiness.

(Weight Per Square-meter)

It is according to the weight per square-meter, prescribed in JIS L 1096.

(Tear Strength)

It is according to the tear strength prescribed in JIS L 1096 (the pendulum method). About two directions of the direction in which the warp is cut, and that in which the weft is cut, tear strengths are measured.

Example 1

A nylon 6 polymer having a relative viscosity ηr of 3.51 was meted and spun from a nozzle having 20 round holes at a spinning temperature of 280° C. The resultant polymer was drawn at a spinning speed of 2400 m/minute and a drawing temperature of 160° C. to yield a multifilament made of 22 dtex/20 filaments. The stress thereof was 2.10 cN/dtex when the filament was lengthened by 10%, and the elongation was 50%. The yarns were used for the warp and the weft, and the warp density and the weft density were set to 183/2.54-cm and 178/2.54-cm, respectively. The yarns were woven into a fabric with a rip stop texture illustrated in FIG. 1.

The resultant gray fabric was soaped and dyed in a usual manner. Subsequently, one surface of the resultant was subjected to calendaring (conditions: cylinder temperature: 120° C., pressure: 25 kgf/cm$^2$, and speed: 20 m/minute) two times. In this way, a cloth was yielded, the warp density of which was 198/2.54-cm, and the weft density of which was 184/2.54-cm. The resultant cloth had a latitude tear strength of 18.6 N, a longitude tear strength of 14.7 kgf, and a thickness of 0.066 mm. The feeling thereof was very soft, and the glossiness was restrained into a low value. Although the cloth was thin, the tear strength thereof was excellent.

Example 2

Figure 2:
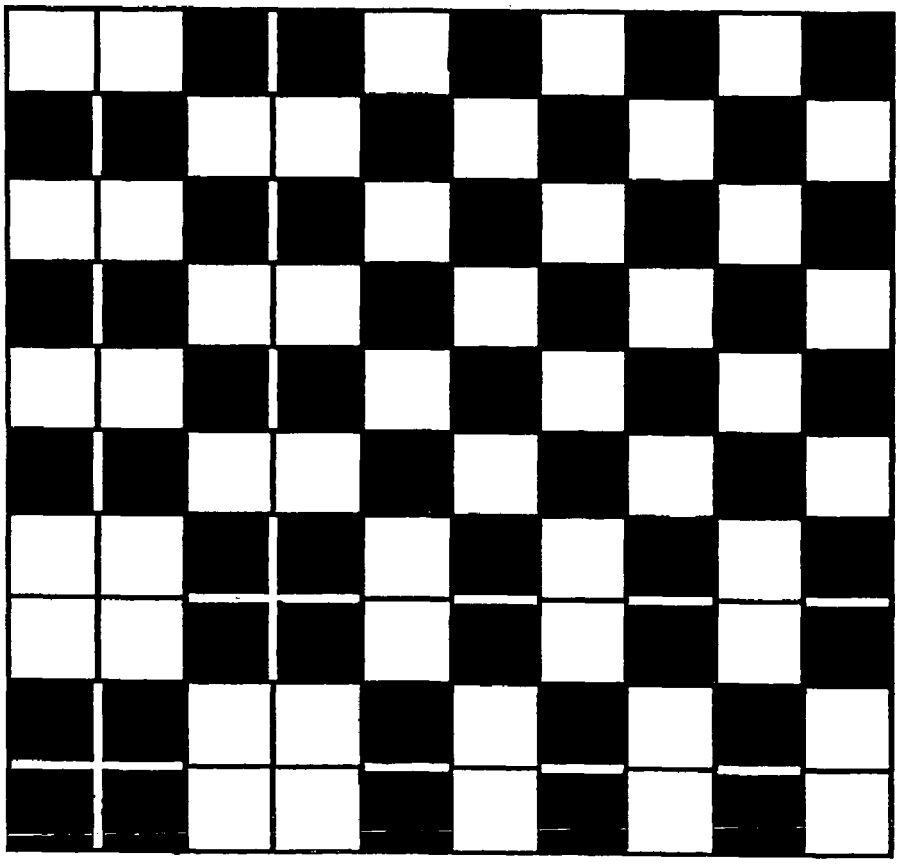
FIG. 2 is a chart illustrating another example of the weave design of the fabric of the present invention.

The present example was conducted in accordance with Example 1 except that the yarns were woven into a fabric with a mini double rip texture illustrated in FIG. 2. The hand of the fabric was very soft. Although the cloth was thin, the tear strength thereof was excellent.

Comparative Example 1

The present example was conducted in accordance with Example 1 except that double side calendaring was conducted instead of the single side calendaring. Because of the double side calendaring, the tear strength became low and the surface glossiness was too high.

Comparative Example 2

Instead of the single side calendaring, metal plates having a clearance of 50 μm were used to coat the fabric with the following resin. Thereafter, the resultant was subjected to curing treatment at 130° C. for 1 minute.

Paracron (transliteration) AM-200 (acrylic resin, manufactured by Negami Chemical Industrial Co., Ltd.): 100 parts, Toluene: 10 parts, and Panlon (transliteration) LN (crosslinking agent for the acrylic resin, manufactured by Negami Chemical Industrial Co., Ltd.): 2 parts.

The viscosity of the resin was adjusted to 10000 cps (model B viscometer, rotor No. 5, speed of rotation : 20 rpm) with various solvent concentrations.

The tear strength became low because of the resin coating.

Comparative Example 3

The present example was conducted in accordance with Example 1 except that a nylon 6 fiber for 44 dtex/34 filaments shown in Table 1 was used, and the weave density was changed to weave the fiber into a cloth. The resultant cloth was heavy since the thick yarn was used.

Comparative Example 4

The present example was conducted in accordance with Example 1 except that a nylon 6 fiber for 33 dtex/24 filaments shown in Table 1 was used and woven into a fabric with a rip weave. The tear strength was satisfactory since the fiber was woven in the state that the weave density was lowered. However, the air permeability was too high, and thus the cloth was unsuitable for down jackets.

Comparative Example 5

The present examples was conducted in accordance with Example 1 except that a nylon 66 fiber for 7 dtex/10 filaments shown in Table 1 was used and woven under conditions shown in Table 1. The resultant had a low tear strength since the linear density of the yarn was too low.

TABLE 1

| Items | Unit | Example 1 | Example 2 | Comparative Example 1 | Comparative Example 2 | Comparative Example 3 | Comparative Example 4 | Comparative Example 5 |
|---|---|---|---|---|---|---|---|---|
| Tear strength in the warp cut direction | N | 18.6 | 17.7 | 8.8 | 11 | 18.2 | 14.5 | 8.7 |
| Tear strength in the weft cut direction | N | 14.7 | 14.2 | 7.9 | 9 | 10.3 | 13.3 | 7.8 |
| Weight per unit area | g/m$^2$ | 35.8 | 34.9 | 35.5 | 41 | 61.5 | 49 | 20.5 |
| Air permeability | cm$^3$ · cm$^2$ · s | 0.89 | 0.91 | 0.88 | 0.5 or less | 0.75 | 10.2 | 1.2 |
| Bending rigidity | gf · cm$^2$/cm | 0.010 | 0.011 | 0.009 | 0.033 | 0.027 | 0.024 | 0.007 |
| Thickness | mm | 0.066 | 0.069 | 0.065 | ← | 0.12 | 0.10 | 0.043 |
| Cover factor | — | 1791 | 1782 | 1791 | ← | 2242 | 1545 | 1572 |
| Density ratio | — | 1.08 | 1.07 | 1.08 | ← | 1.84 | 1.17 | 1.08 |
| Yarn linear density | dtex | 22 | 22 | 22 | ← | 44 | 33 | 10 |
| Fiber fineness | dtex | 1.1 | 1.1 | 1.1 | ← | 1.3 | 1.4 | ← |
| Polyamide polymer | — | Nylon 6 | ← | ← | ← | ← | ← | Nylon 66 |
| Rip stop | — | Mini mini rip | Mini double rip | Mini mini rip | ← | ← | ← | ← |
| Rip stop width | mm × mm | 0.64 × 0.69 | 1.3 × 1.4 | 0.64 × 0.69 | ← | 0.58 × 1.07 | 0.88 × 1.02 | 0.52 × 0.55 |
| Singe side calendaring | — | Two times, a single face | ← | Calendaring, both faces | Resin, a single face | Two times, a single face | ← | ← |
| Glossiness (of the face having a lower value) | — | 2.5 | 2.8 | 3.3 | 2.9 | 2.2 | 2.3 | 2.2 |
| Relative viscosity | — | 3.51 | ← | ← | ← | ← | ← | 3.3 |
| Yarn breaking strength | cN/dtex | 5.8 | ← | ← | ← | 6.7 | 6.2 | 4.7 |
| Breaking elongation | % | 50 | ← | ← | ← | 44.4 | 46.0 | 46.0 |
| ST10 | cN/dtex | 2.1 | ← | ← | ← | 2.4 | 2.7 | 2.9 |
| Gray fabric warp density, | The number of yarns/2.54-cm | 183 | 182 | 183 | ← | 201 | 129 | 222 |
| Gray fabric weft density | The number of yarns/2.54-cm | 178 | 178 | 178 | ← | 111 | 115 | 211 |
| Product warp density | The number of yarns/2.54-cm | 198 | 196 | 198 | ← | 219 | 145 | 246 |

TABLE 1-continued

| Items | Unit | Example 1 | Example 2 | Comparative Example 1 | Comparative Example 2 | Comparative Example 3 | Comparative Example 4 | Comparative Example 5 |
|---|---|---|---|---|---|---|---|---|
| Product weft density | The number of yarns/2.54-cm | 184 | 184 | 184 | ← | 119 | 124 | 228 |
| Weave design chart | — | FIG. 1 | FIG. 2 | FIG. 1 | ← | ← | ← | ← |

the symbol "←" means the same as in the left adjacent cell.

Industrial Applicability

According to the present invention, it is possible to provide a fabric which is excellent in tear strength in the longitude direction and that in the latitude direction even if the fabric is thin, and which has a very soft feeling, a low glossiness, and a low air permeability.

The invention claimed is:

1. A fabric having a thickness of 0.07 mm or less and comprising a rip stop weave wherein the rip widths of the longitude and latitude thereof are each 5 mm or less wherein the tear strength in the warp cut direction and that in the weft cut direction according to the pendulum method are each from 10 to 50 N, the weight per square-meter is 50 g/m$^2$ or less, the air permeability is 1.5 cm$^3$/cm$^2$·s or less, and the yarn linear density is 25 dtex or less.

2. The fabric according to claim 1, wherein the bending rigidity according to KES is 0.025 gf·cm$^2$/cm or less.

3. The fabric according to claim 1, wherein the cover factor is from 1600 to 2000.

4. The fabric according to claim 2, wherein the cover factor is from 1600 to 2000.

5. The fabric according to claim 1, wherein the ratio of the warp density to the weft density is from 0.9 to 1.2.

6. The fabric according to claim 2, wherein the ratio of the warp density to the weft density is from 0.9 to 1.2.

7. The fabric according to claim 1, comprising a polyamide multifilament wherein the fiber fineness is 1.2 dtex or less.

8. The fabric according to claim 2, comprising a polyamide multifilament wherein the fiber fineness is 1.2 dtex or less.

9. The fabric according to claim 1, comprising a nylon 6 multifilament wherein the fiber fineness is 1.2 dtex or less.

10. The fabric according to claim 2, comprising a nylon 6 multifilament wherein the fiber fineness is 1.2 dtex or less.

11. The fabric according to claim 1, comprising a rip stop weave wherein the rip widths of the longitude and latitude thereof are each 1.5 mm or less.

12. The fabric according to claim 1, wherein the rip widths of the longitude and latitude of the rip stop weave are each 1.5 mm or less.

13. A fabric having a thickness of 0.07 mm or less and comprising a rip stop weave wherein the rip widths of the longitude and latitude thereof are each 5 mm or less wherein the tear strength in the warp cut direction and that in the weft cut direction according to the pendulum method are each from 10 to 50 N, the weight per square-meter is 50 g/m$^2$ or less, the air permeability is 1.5 cm$^3$/cm$^2$·s or less, and the yarn linear density is 25 dtex or less, wherein the fabric is without resin finish and double side calendaring.

14. The fabric according to claim 13, wherein the bending rigidity according to KES is 0.025 gf·cm$^2$/cm or less.

15. The fabric according to claim 13 with single side calendaring.

16. The fabric according to claim 14 with single side calendaring.

17. The fabric according to claim 1, wherein the glossiness of one surface is 3.0 or less.

18. The fabric according to claim 2, wherein the glossiness of one surface is 3.0 or less.

* * * * *